US006302939B1

(12) United States Patent
Rabin et al.

(10) Patent No.: US 6,302,939 B1
(45) Date of Patent: Oct. 16, 2001

(54) RARE EARTH PERMANENT MAGNET AND METHOD FOR MAKING SAME

(75) Inventors: Barry H. Rabin; Charles H. Sellers, both of Idaho Falls, ID (US)

(73) Assignee: Magnequench International, Inc., Anderson, IN (US)

( * ) Notice: Subject to any disclaimer, the term of this patent is extended or adjusted under 35 U.S.C. 154(b) by 0 days.

(21) Appl. No.: 09/241,978

(22) Filed: Feb. 1, 1999

(51) Int. Cl.[7] ..... B22D 9/10
(52) U.S. Cl. ..... 75/338; 75/234
(58) Field of Search ..... 75/333, 334, 338, 75/339

(56) References Cited

U.S. PATENT DOCUMENTS

| | | | |
|---|---|---|---|
| 3,720,737 | | 3/1973 | Klaphaak et al. . |
| 4,078,873 | | 3/1978 | Holiday et al. . |
| 4,140,462 | | 2/1979 | Thompson . |
| 4,207,040 | | 6/1980 | Metcalfe et al. . |
| 4,210,471 | | 7/1980 | Yoneyama et al. . |
| 4,213,803 | | 7/1980 | Yoneyama et al. . |
| 4,284,394 | | 8/1981 | Thompson . |
| 4,310,292 | | 1/1982 | Carlson et al. . |
| 4,375,440 | | 3/1983 | Thompson . |
| 4,419,060 | | 12/1983 | Speier et al. . |
| 4,419,061 | | 12/1983 | Patterson, II . |
| 4,456,444 | | 6/1984 | Patterson, II . |
| 4,496,395 | | 1/1985 | Croat . |
| 4,585,473 | | 4/1986 | Narasimhan et al. . |
| 4,601,875 | | 7/1986 | Yamamoto et al. . |
| 4,619,845 | | 10/1986 | Ayers et al. . |
| 4,801,340 | | 1/1989 | Inoue et al. . |
| 4,802,931 | | 2/1989 | Croat . |
| 4,836,868 | | 6/1989 | Yajima et al. . |
| 4,881,986 | | 11/1989 | Sato et al. . |
| 4,902,361 | | 2/1990 | Lee et al. . |
| 4,919,732 | | 4/1990 | Yang et al. . |
| 4,952,239 | * | 8/1990 | Tokunaga et al. ..... 148/302 |
| 4,994,109 | | 2/1991 | Willman et al. . |
| 5,049,203 | | 9/1991 | Mukai et al. . |
| 5,049,208 | | 9/1991 | Yajima et al. . |
| 5,125,574 | | 6/1992 | Anderson et al. . |
| 5,135,584 | * | 8/1992 | Fujiwara ..... 148/301 |
| 5,181,973 | | 1/1993 | Hirose et al. . |
| 5,209,789 | | 5/1993 | Yoneyama et al. . |
| 5,228,620 | | 7/1993 | Anderson et al. . |
| 5,240,513 | | 8/1993 | McCallum et al. . |
| 5,242,508 | | 9/1993 | McCallum et al. . |
| 5,302,182 | * | 4/1994 | Gorynim et al. ..... 75/334 |
| 5,309,977 | | 5/1994 | Yoneyama et al. . |
| 5,332,198 | | 7/1994 | Yeh et al. . |

(List continued on next page.)

OTHER PUBLICATIONS

D.J. Branagan et al., Eliminating Degradation During Bonding of Gas Atomized Nd–Fe–B, IEEE Trans. Magn. 33, p. 3838 (1997).

(List continued on next page.)

*Primary Examiner*—John Sheehan
(74) *Attorney, Agent, or Firm*—Pennie & Edmonds LLP

(57) ABSTRACT

A rare earth permanent magnet alloy having a composition expressed as $R_xF_{100-(x+y+z+m+n)}B_yT_zM_mD_n$. In this formula, R is one or more of rare earthy elements, such as neodymium, lanthanum, cerium, dysprosium and/or praseodymium; F is Fe or Fe and up to 20 atomic percent of Co by substitution; B is boron; T is one or more elements selected from the group of Ti, Zr, Cr, Mn, Hf, Nb, V, Mo, W and Ta; M is one or more elements selected from the group of Si, Al, Ge, Ga, Cu, Ag, and Au; and D is one or more elements selected from the group of C, N, P, and O. In this formula, x, y, z, m, n are atomic percentages in the ranges of $3<x<15$, $4<y<22$, $0.5<z<5$, $0.1<m<2$, and $0.1<n<4$. Fine amorphous particles of such alloy are made by atomization and/or splat-quenching. Both substantially-spherical, irregular and substantially plate-like particles are simultaneously produced.

7 Claims, 1 Drawing Sheet

U.S. PATENT DOCUMENTS

| | | | | |
|---|---|---|---|---|
| 5,372,629 | | 12/1994 | Anderson et al. . | |
| 5,431,747 | | 7/1995 | Takebuchi et al. . | |
| 5,470,401 | | 11/1995 | McCallum et al. . | |
| 5,486,240 | | 1/1996 | McCallum et al. . | |
| 5,545,266 | | 8/1996 | Hirosawa et al. . | |
| 5,580,399 | | 12/1996 | Tamai et al. . | |
| 5,595,608 | | 1/1997 | Takebuchi et al. . | |
| 5,665,177 | | 9/1997 | Fukuno et al. . | |
| 5,803,992 | * | 9/1998 | McCallum et al. | 148/302 |
| 5,858,123 | * | 1/1999 | Uchido et al. | 148/302 |
| B1 4,836,868 | | 5/1992 | Yajima et al. . | |

OTHER PUBLICATIONS

D.J. Branagan et al., A New Generation of Gas Atomized Power with Improved Levels of Energy Product and Processability, IEEE Trans. Magn. 32, p. 5097 (1996).

D.J. Branagan et al., Developing rare earth permanent magnet alloys for gas atomization, J. Phys. Dq 29, 2376 (1996).

L.H. Lewis et al., Factors Affecting Coercivity in Rare–Earth–Based Advanced Permanent Magnet Materials in R.G. Bautista, ed. *Rare Earths: Science, Technology and Applications III*, p. 119 (The Minerals, Metals & Materials Society 1997).

C.H. Sellers et al., Permanent Magnet Powders Produced by Gas Atomization, in G.C. Hadjipanayis, ed *Magnetic Hysteresis in Novel Magnetic Materials*, p. 651 (Kluwer Academic 1996).

C.H. Sellers et al., *Amorphous Rare Earth Magnet Powders*, in F.P. Missell et al., eds., Rare Earth Magnets and Their Applications, p. 28 (1996).

C.H. Sellers, Amorphous Rare Earth Permanent Magnet Powders with Improved Magnetic Properties Produced at Lower Cost by Gas Atomization, Mat. Tech. 11.4:131, p. 219 (1996).

* cited by examiner

RARE EARTH PERMANENT MAGNET AND METHOD FOR MAKING SAME

FIELD OF THE INVENTION

The present invention relates to permanent magnetic materials and more particularly, permanent magnetic materials composed of rare earth, iron, boron and additional elements and/or compounds.

BACKGROUND OF THE INVENTION

Magnetic properties of a permanent magnet material, such as the known neodymium (Nd)-iron (Fe)-boron (B) permanent magnet alloy (e.g., $Nd_2Fe_{14}B$), can be altered by changing the alloy composition. For example, elements may be added to the alloy as substitution of existing alloying elements on the same lattice sites. More specifically, in the Nd—Fe—B alloy system, the magnetic properties can be altered by direct substitution of Fe, Nd and B by other elements at the Fe, Nd or B sites.

Magnetic properties of a magnetic material can also be altered by changing the microstructure of such alloy by changing the process conditions under which the alloy is made. For example, by rapid solidification, such as melt-spinning or atomization, it is possible to change the magnetic properties of such alloy by forming an extremely fine grain size directly from the melt or by over-quenching and then recrystallizing grains during a short time anneal.

Nd—Fe—B ribbons produced by the current industry practice of melt-spinning are known to exhibit both microstructure and magnetic property variations between the surface of the ribbons that touched the melt-spinning wheel and the free surface that did not touch the melt-spinning wheel, because of the differences in cooling rate across the ribbon thickness. Improvements in melt-spinning processes or products are therefore generally sought in two areas:(1) elimination of the inhomogeneities to yield better magnetic properties; or (2) increasing the production throughput while not further sacrificing homogeneity or properties. Current commercial production of Nd—Fe—B material by melt-spinning is limited to a throughput rate on the order of 0.5 kg per minute.

U.S. Pat. No. 4,919,732 describes melt-spinning a Nd—Fe—B melt to form rapidly-solidified flakes that include zirconium, tantalum, and/or titanium and boron in solid solution. The melt-spun flakes are then comminute to less than 60 mesh. They are subjected to a recrystallization heat treatment to precipitate diboride dispersoids for the purpose of stabilizing the fine grain structure against grain growth during subsequent elevated temperature magnet fabrication processes.

A disadvantage associated with use of precipitated diborides of hafnium (Hf), zirconium (Zr), tantalum (Ta), and/or titanium (Ti) to slow grain growth is the alloy competition between using the boron to form the boride and using the boron to form the tenary Nd—Fe—B 2-14-1 phase. This means that during alloying, extra boron is needed for compensating for this effect, which changes the location on the ternary Nd—Fe—B phase diagram and the resulting solidification sequence.

U.S. Pat. No. 5,486,240 describes a method for making a permanent magnet by rapidly solidifying a melt (of a rare earth permanent magnet alloy) to form particulates having a substantially amorphous (glass) structure or over-quenched microcrystalline structure. The melt has a base alloy composition comprising one or more rare earth elements, iron and/or cobalt, and boron. The alloy composition further comprises at least one of the following so-called transition metal elements (TM): Ti, Zr, Hf, V, Nb, Ta, Cr, Mo, W and Al. The composition also includes at least one of carbon (C) and nitrogen (N) in substantially stoichiometric amounts with the transition metal TM to form a thermodynamically stable compound (e.g., transition metal carbide, nitride and/or carbonitride).

It is purported that the transition metal carbide, nitride and/or carbonitride compound is more thermodynamically stable than other compounds formable between the additives (i.e., TM, C and/or N) and the base alloy components (i.e., RE, Fe and/or Co, B) such that the base alloy composition is unchanged as a result of the presence of the additives in the melt. In one embodiment, the base alloy composition includes $Nd_2Fe_{14}B$, and elemental Ti and C and/or N provided in substantially stoichiometric amounts to form TiC and/or TiN precipitates.

It is disclosed in the '240 patent that the presence of the transition metal additive(s) (e.g. Ti, Zr, Hf, V, Nb, Ta, Cr, Mo, W, and Al) in the melt advantageously affects the glass forming behavior. That is, a much slower melt cooling rate can be used to achieve an amorphous structure. Thus, alloy component modifications (i.e., the amount of TM added) can be used to alter the glass forming ability to insure the desired amorphous structure is achieved in the rapidly solidified particulates.

However, there are several drawbacks associated with adding stoichiometric carbide, nitride and/or carbonitride to a Nd—Fe—B alloy. For example, it has been found that adding a large amount of compound forming elements (e.g., titanium and carbon) as a means of enhancing quenchability occurs at the expense of magnetic properties. There are two reasons for this: First, the added elements (e.g., titanium and carbon) form a separate nonmagnetic phase from the dominant Nd—Fe—B magnetic phase that dilutes the volume of the magnetic phase in the alloy. This is also called volume dilution.

Second, the added elements (e.g., titanium and carbon) poison the base Nd—Fe—B alloy, resulting in degraded magnetic properties. This effect is due to the fact that not all of the added elements (e.g., titanium and carbon) are used to form the compound (e.g., titanium carbide). Rather, there is always some solubility for the transition metal elements (e.g., Ti) in the 2-14-1 (Nd—Fe—B) phase (approximately 0.06 weight percent in the case of titanium), which effects magnetic properties, particularly magnetic remanence, $B_r$, and maximum energy product, BHmax. In the case of Ti, for example, the negative effects of Ti substitution on the 2-14-1 phase properties are known to be significant.

Consequently, when adding stoichiometric amount of transition metal carbide or nitride (e.g., TiC) to achieve the desired levels of alloy quenchability, the combined reductions in magnetic properties attributable to volume dilution and poisoning of the 2-14-1 phase may render the magnetic properties commercially unacceptable. For example, the inventors of the present invention have shown that for a standard, commercially available Nd—Fe—B alloy composition, the optimum wheel speed used in melt-spinning (a direct measure of quenchability) for forming alloy powders may be reduced from about 20 meters-per-second down to about 8 meters-per-second by adding about three atomic-percent of TiC. However, the reduction in magnetic properties of the alloy appears to be more on the order of 20 to 30 percent, resulting in unacceptable properties, even though the amount of TiC second phase, which is nonmagnetic, comprises only about six volume-percent.

Moreover, it is believed that aluminum (Al) is mistakenly identified in the '240 patent as one of the so-called transition metal elements, because aluminum carbide, aluminum nitride, or aluminum carbonitride is not more thermodynamically stable than other compounds formable between the additives (i.e., TM, C and/or N) and the base alloy components (i.e., RE, Fe and/or Co, B). Thus, adding Al to the basic alloy in accordance with the '240 patent would not achieve the desired results.

It is therefore an object of the present invention to provide one or more additive elements and/or compounds to a base Nd—Fe—B compound to improve its quenchability;

It is another object of the present invention to minimize any degradation of the alloy magnetic properties caused by such addition of elements and/or compounds; and It is a further object of the present invention to provide a method and apparatus for making such magnetic alloy at higher production through put than what has been possible in the past.

SUMMARY OF THE INVENTION

These and other objects are achieved by the present invention which provides a magnetic alloy composition having an enhanced quenchability and a method for making magnetic alloy powders having such composition.

In accordance with the present invention, a rare earth permanent magnet alloy is provided having a composition expressed as $R_xF_{100-(x+y+z+m+n)}B_yT_zM_mD_n$. In this composition, R is one or more of rare earth elements, such as, but not limited to, neodymium, lanthanum, cerium, dysprosium and/or praseodymium; F is Fe or Fe and up to 20 atomic percent of Co by substitution; B is boron; T is one or more elements selected from the group of Ti, Zr, Cr, Mn, Hf, Nb, V, Mo, W and Ta; M is one or more elements selected from the group of Si, Al, Ge, Ga, Cu, Ag, and Au; and D is one or more elements selected from the group of C, N, P, and O. In this formula, x, y, z, m, n are atomic percentages in the ranges of $3<x<15$, $4<y<22$, $0.5<z<5$, $0.1<m<2$, and $0.1<n<4$.

Particles of such alloy are produced by first forming a melt having such composition, followed by rapidly solidifying the melt to form substantially amorphous solid particles. Preferably, particles are formed by rapidly cooling from the melt at a cooling rate greater than about $10^5$ degrees (centigrade) per second. More preferably, the particles are formed by a centrifugal atomization process which mass-produces the particles at a rate greater than about 0.5 kilogram per minute and up to 100 kilograms per minute.

In accordance with the present invention, alloy particles can be formed substantially spherical in shape, irregular in shape, or substantially plate-like in shape. A combination of these shapes may also be produced in accordance with the present invention. Preferably, the fine particles have a size ranging between 1 and 200 micro meters in diameter, and the plate-like particles have a size ranging between 50 and 500 micrometers in length and between 20 and 100 micrometers in thickness.

In accordance with present invention, the particles formed by rapid solidification are heated under a vacuum or an inert atmosphere at a temperature between 500 degrees centigrade and 850 degrees centigrade for a time between 1 to 300 minutes to transform the particles into a structure consisting of between 30 and 95 percent by volume of crystallites of the tetragonal 2-14-1 magnetic phase having dimensions of between 0.02 and 0.2 micrometer. This annealing step increases the coercivity $H_{ci}$ to at least 2 kOe, the remnant magnetization $B_r$ to at least 5 kG, and the maximum energy product $BH_{max}$ to at least 7 MGOe. The heat-treated particles are then made into a magnet by either polymer bonding or by heat-consolidation.

BRIEF DESCRIPTION OF THE DRAWING

These and other features, objects, and advantages of the present invention will become more apparent from the following detailed description in conjunction with the appended drawing, in which.

DETAILED DESCRIPTION OF THE INVENTION

Figure 1:
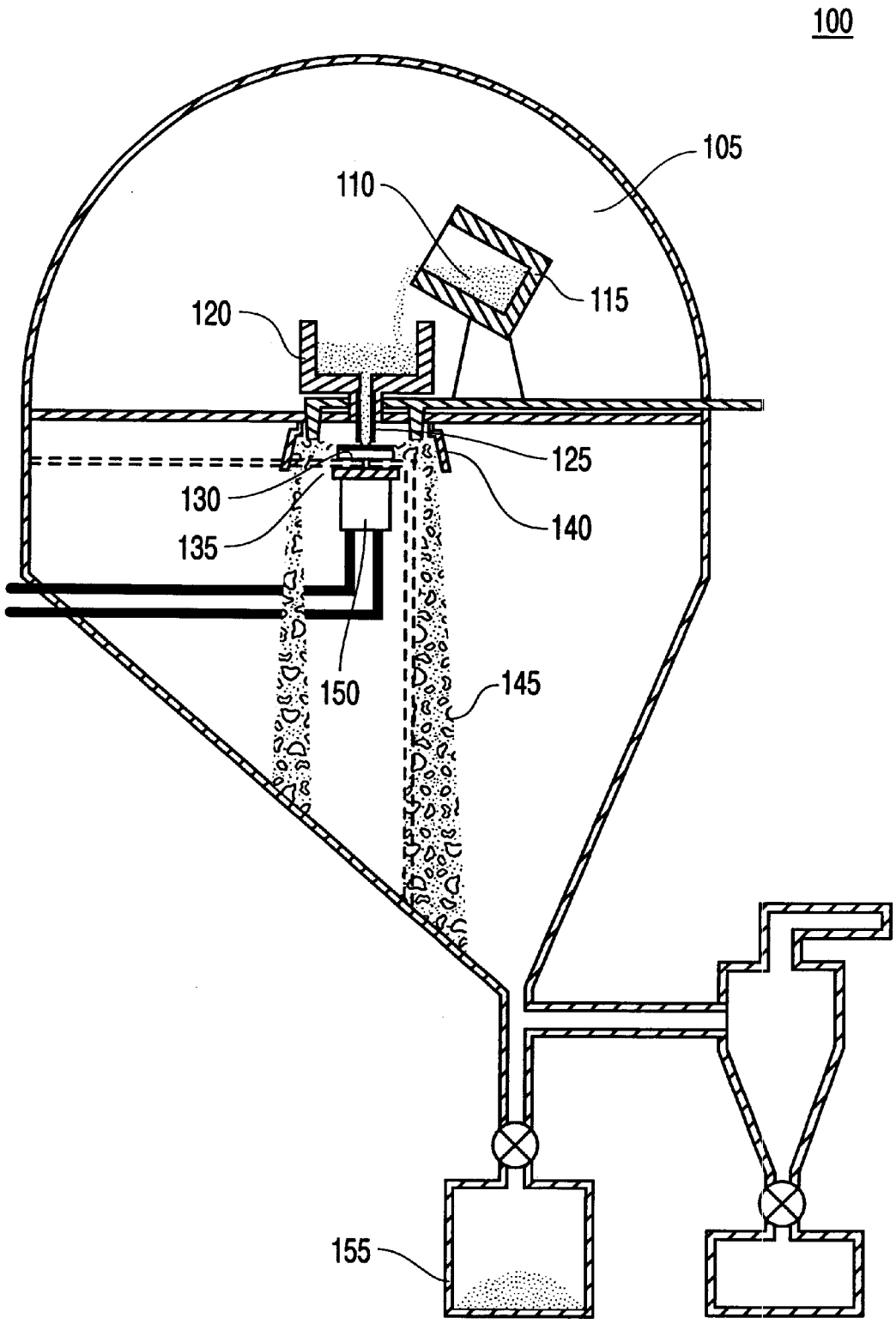
FIG. 1 illustrates a preferred embodiment of a centrifugal atomization apparatus of the present invention for making magnetic alloy powders of the present invention.

In accordance with the present invention, a rare earth permanent magnet alloy is provided. The composition of the alloy is expressed as $R_xF_{100-(x+y+z+m+n)}B_yT_zM_mD_n$. In this formula, R is one or more of rare earth elements, such as, but not limited to, neodymium, lanthanum, cerium, dysprosium and/or praseodymium; F is Fe or Fe and up to 20 atomic percent of Co by substitution; B is boron; T is one or more elements selected from the group of Ti, Zr, Cr, Mn, Hf, Nb, V, Mo, W and Ta; M is one or more elements selected from the group of Si, Al, Ge, Ga, Cu, Ag, and Au; and D is one or more elements selected from the group of C, N, P, and O. In this formula, x, y, z, m, n are atomic percentages in the ranges of $3<x<15$, $4<y<22$, $0.5<z<5$, $0.1<m<2$, and $0.1<n<4$.

In the above-described alloy, group M elements are substantially not bonded to group D elements to form a compound, because such compound would not be thermodynamically stable in this alloy. However, group M elements may bond with group T elements to form stable compounds. In accordance with the present invention, advantageously, the amount of all group T elements together is not necessarily in stoichiometric amount with all of the group D elements together.

By using non-stoichiometric additions of the compound forming elements, superior magnetic properties are achieved as compared to the case where the compound forming elements are provided in substantially stoichiometric amounts. More specifically, in cases where the negative effects of poisoning are known (e.g., when the T elements contain Ti), by using additions in which the non-metallic elements of group D is provided over the stoichiometric amount (e.g., 1–10% excess) of metallic elements of group T, substantially all of the metallic elements of group T are incorporated into compounds, thereby minimizing substitution of such elements into the base 2-14-1 phase and the associated magnetic property degradation due to poisoning. Preferably, the excess non-metallic element (e.g., C) is capable of being incorporated into the 2-14-1 phase without seriously compromising magnetic properties of the alloy (e.g., by direct substitution of B by C in stoichiometric 2-14-1 phase). Alternatively, in cases where the metallic elements of group T do not poison the magnetic properties of the 2-14-1 phase but rather enhance the magnetic properties of the alloy in (e.g., additions of the T element Nb are known to enhance $H_{ci}$), by using additions in which metallic element of group T is provided over the stoichiometric amount of the non-metallic elements of group D, substantially all of the non-metallic elements of group D are incorporated into compounds, thereby leaving an excess amount of the metallic elements from group T which, advantageously, enhances the magnetic properties of the alloy.

In accordance with the present invention, the addition of the M category of elements allows to achieve comparable levels of enhanced alloy quenchability while using less of the compound forming additives. In this case, the elements added either substitute for Fe in 2-14-1 phase (e.g, Si, Al) or they promote the formation of another phase that impacts the magnetic properties in a predictable fashion (e.g., Ga). For example, an optimum wheel speed of 8 meters-per-second is achieved using only one atomic percent of TiC addition (compared to three atomic percent of TiC mentioned above) by adding 0.5 to 2 atomic percent of one or more M elements (e.g., Cu, Al, Si and/or Ga). The magnetic properties are superior to those resulting from TiC addition alone. It should be apparent to one skilled in the art that the magnetic alloy composition of the present invention may include minor amount of impurity elements, such as magnesium, calcium, oxygen and/or nitrogen.

Preferably, the alloy is made by first rapidly solidifying the melt having the same composition at a cooling rate greater than about $10^{5°}$ C. per second, and which is mass-produced at a rate greater than about 0.5 kg/min and up to 100 kg/min to yield substantially amorphous solid particles. The amorphous particles are then heat-treated under an inert environment, such as under vacuum or inert gas atmosphere, at a temperature between 500° C. and 850° C. and for a time between 1 min and 300 mins. This annealing step transforms the alloy material into a structure consisting of between 30% and 95% by volume of crystallites of the tetragonal 2-14-1 magnetic phase having dimensions of between 0.02 and 0.2 micrometers, thereby increasing the coercivity $H_{ci}$ to at least 2 kOe, increasing the remnant magnetization $B_r$ to at least 5 kG, and increasing the maximum energy product $BH_{max}$ to at least 7 MGOe.

FIG. 1 illustrates a preferred embodiment of an atomization apparatus of the present invention. This apparatus 100 includes a melt chamber 105 where an alloy 110 is melted under vacuum or an inert atmosphere by any suitable means, such as induction, arc, plasma, or e-beam melting, in a furnace 115. Melt 110 is then delivered to a tundish 120 having a nozzle 125 for introducing a molten stream of the alloy onto a rotating disk or cup 130. Rotating disk or cup 130 breaks the molten stream into fine liquid droplets by centrifugal atomization. The centrifugally atomized fine liquid droplets are then cooled by a cooling medium 135, such as a high velocity helium gas, to produce rapidly solidified, substantially spherical droplets. The substantially spherical droplets are further splat-quenched by a stationary or rotating water-cooled splat quenching shield 140 to produce substantially flake-like particles 145. Illustratively, a turbine or electrical motor 150 is used to drive rotating table 130. The splat-quenched powders as produced are then collected in a chamber 155.

In this preferred embodiment, centrifugal atomization is used to produce fine particles. However, it should be apparent to one skilled in the art that other atomization method suitable for fine particles production, such as gas atomization or water atomization, may be used in place of the centrifugal atomization described herein.

In accordance with the invention, fine powders may be produced by using only the cooling medium but no splat-quenching; and flake powders may be produced by using only the splat-quenching (by the shield) but no cooling medium. In addition, a combination of fine particle shapes can be simultaneously produced in the apparatus of the present invention described above by adjusting the size and velocity of the cooling medium such that only particles below a certain size solidify after going through the medium; larger droplets exit the cooling medium still molten and impact the splat quenching shield to produce flakes. The flakes can be either separated from the other particle shapes by a suitable method, allowing each product to be used separately, or the rapidly solidified product can be a mixture of particle morphologies. The advantages of this process are discussed below.

The simultaneous production of different particle morphologies greatly increases production yields for atomization processing. For atomized powders, the smaller the particles are, the faster the cooling rate for such particles (equivalent to increasing wheel speed during melt-spinning). In prior atomization studies, only the finest atomized particles (e.g., particles having a diameter of less than 5 microns) cool fast enough to produce over-quenched material that yields acceptable magnetic properties. Using the enhanced quenchability alloys of the present invention, over-quenched particles having larger sizes, e.g., about 50 microns, are made. This offers practical and commercial advantages because the yield of small particles is usually very low and fine particles are difficult to handle. With larger-size overquenched particles, both high yield and high throughput are achieved. These powders are easier to handle and exhibit better magnetic properties than powders having the same particle size that are produced from crushing melt-spun ribbons. Such atomized particles are ideally suited for producing magnet articles by injection molding.

A second advantage of the simultaneous production of different particle morphologies is that it is possible to control the apparatus to produce flakes only from droplets equal to or greater than a specified size rather than getting flakes from all droplets sizes, as would be the case if only splat-quenching is used. Since the size of a flake produced relates to the size of the starting droplet, flakes within only certain desired size ranges are thus produced.

Another improvement of flake production by the atomization method of the present invention is that superior quality flakes in smaller sizes can be produced, as compared to what can be produced by crushing melt-spun ribbons. Currently, flakes smaller than about 75 micrometers cannot be produced by melt-spinning because crushing the flakes smaller and smaller exposes more and more fresh surface area of the flakes to the atmosphere, making them more reactive and therefore resulting in a loss in magnetic properties due to oxidation and/or establishment of dangerously flammable conditions. Since smaller flakes are produced in accordance with the present invention, which do not require further crushing, the surface of the flakes produced by this atomization method is already passivated and are therefore inherently more stable. In accordance with the present application, stable and usable flakes with particle sizes well below 75 micrometers are produced, which are ideally suited for fabrication of magnet articles by the process of injection molding.

Finally, flake materials with superior magnetic properties compared to melt-spun flakes are produced. The improvements in magnetic properties come from achieving a more homogeneous microstructure which results from higher cooling rates. For example, the melt-spinning process is claimed to achieve cooling rates on the order of 1,000,000° K/s which allows to produce over-quenched material. In accordance with the present invention, over-quenched material having the composition of the present invention is produced with cooling rates on the order of only 10,000 to 100,000° K/s. This is due to the high quenchability of the alloy composition. In terms of production throughput, 100 kg/min and more has been achieved in accordance with the present invention. In addition, the alloy composition of the present invention may also be used in a conventional melt-spinning process to achieve ribbons having improved homogeneity across the ribbon thickness.

In accordance with the present invention, the production of flakes by atomization and splat-quenching is capable of achieving a cooling rate comparable to or higher than that achievable by a melt-spinning process and a higher production rate than that of atomization. Accordingly, uniformly over-quenched material is easily produced at a substantially higher production rate.

To form a magnet, the crystallized particulates are mixed with a binder to form a bonded magnet compression molding, injection molding, extrusion, tape calendering, or by any other suitable method. A magnet can also be formed by consolidating the particles at an elevated temperature. Consolidation techniques, such as sintering, hot-pressing, hot-extrusion, die-upsetting, or others involving the application of pressure at elevated temperatures may be used. During elevated temperature consolidation, the primary and secondary precipitates act to pin the grain boundaries and minimize deleterious grain growth that is harmful to magnetic properties.

It will be apparent to those skilled in the art that numerous modifications may be made within the scope of the invention, which is defined in accordance with the following claims.

What is claimed is:

1. Method for producing a mixture of particles of different morphologies comprising one or more rare earth elements, iron and boron, said method comprising the steps of:

providing a molten alloy comprising rare earth, iron and boron;

introducing said molten alloy onto a rotating disk to produce droplets of said alloy;

cooling said droplets by subjecting said droplets to a gaseous cooling medium such that a first portion of said droplets solidifies into substantially spherical or irregular particles and a second portion of said droplets remains molten;

impacting said second portion of said droplets and said substantially spherical or irregular particles, after being cooled by said gaseous cooling medium, onto a splat shield such that said second portion of said droplets impact said splat shield to form substantially plate-like particles.

2. The method of claim 1, wherein the substantially spherical or irregular particles have diameters ranging between 1 and 200 micrometers.

3. The method of claim 1, wherein the plate-like particles have sizes ranging between 50 and 500 micrometers in length and between 20 and 100 micrometers in thickness.

4. The method of claim 1, wherein said impacting of said second portion of said droplets is performed at a cooling rate of between 10,000 and 100,000° K/second.

5. The method of claim 1, wherein said substantially plate-like particles are formed at a rate of between 0.5 and 100 kg/minute.

6. The method of claim 1, wherein said gaseous cooling medium is helium gas.

7. The method of claim 1, wherein said splat shield is a stationary or rotating water-cooled splat quenching shield.

* * * * *